United States Patent [19]

Dick

[11] 4,015,530

[45] Apr. 5, 1977

[54] TWO CHANNEL OPTICAL FUZING SYSTEM

[75] Inventor: John O. Dick, Riverside, Calif.

[73] Assignee: The United States of America as represented by the Secretary of the Navy, Washington, D.C.

[22] Filed: Mar. 30, 1966

[21] Appl. No.: 540,145

[52] U.S. Cl. ..... 102/70.2 P

[51] Int. Cl.² ..... F42C 13/04

[58] Field of Search ..... 102/70.2; 88/1; 250/203

[56] References Cited

UNITED STATES PATENTS

| | | | |
|---|---|---|---|
| 2,892,093 | 6/1959 | Henderson | 102/70.2 X |
| 3,125,026 | 3/1964 | Johnson | 102/70.2 P |
| 3,162,119 | 12/1964 | Tate, Jr. et al. | 102/18 |
| 3,242,339 | 3/1966 | Lee | 102/70.2 X |

*Primary Examiner*—Verlin R. Pendegrass
*Attorney, Agent, or Firm*—Richard S. Sciascia; Joseph M. St. Amand; T. M. Phillips

[57] ABSTRACT

A two channel optical fuzing system for determining that a true target is present by initiating a gating pulse when the forward looking channel first detects what appears to be a target and initiating an arming signal when the rearward looking channel sees the same target. If the arming signal initiated during the time interval of the gate pulse, a decision circuit passes an output pulse to the firing circuit which produces a firing pulse to initiate the warhead.

1 Claim, 3 Drawing Figures

JOHN O. DICK
INVENTOR.

BY T. M. Phillips
J. M. St. Amand
ATTORNEYS

JOHN O. DICK
INVENTOR.

BY E. M. Phillips
J. M. St. Amand
ATTORNEYS

TWO CHANNEL OPTICAL FUZING SYSTEM

The invention herein described may be manufactured and used by or for the Government of the United States of America for governmental purposes without the payment of any royalties thereon or therefor.

The present invention relates to a two channel optical fuzing system and more particularly to a two channel optical fuzing system to be used in a guided missile for detonating the missile warhead so as to inflict the maximum possible damage to the target.

Guided missiles utilize optical systems to initiate detonation of the missile when an enemy target radiating infrared energy passes through the detection pattern generated by the system. There have been instances where the warhead detonated prematurely or failed to detonate at all.

The present invention provides a two channel optical fuzing system in which the forward looking channel initiates an arming or gating pulse that persists for a predetermined time duration. If a rearward looking channel sees the same target and generates a signal within the time duration of the arming pulse, the system has determined that a true target is present and a decision circuit passes an output pulse to the firing circuit which produces a firing pulse to initiate the warhead.

Accordingly, an object of this invention is to provide an improved optical fuze system for use in guided missiles.

Another object is to provide a two channel optical fuzing system which will optimize the kill probability of a guided missile warhead.

A further object of the invention is to provide an optical fuzing system which can distinguish between a true target and a decoy.

Other objects and many of the attendant advantages of this invention will become readily appreciated as the same becomes better understood by reference to the following detailed description when considered in connection with the accompanying drawings wherein.

Figure 1:
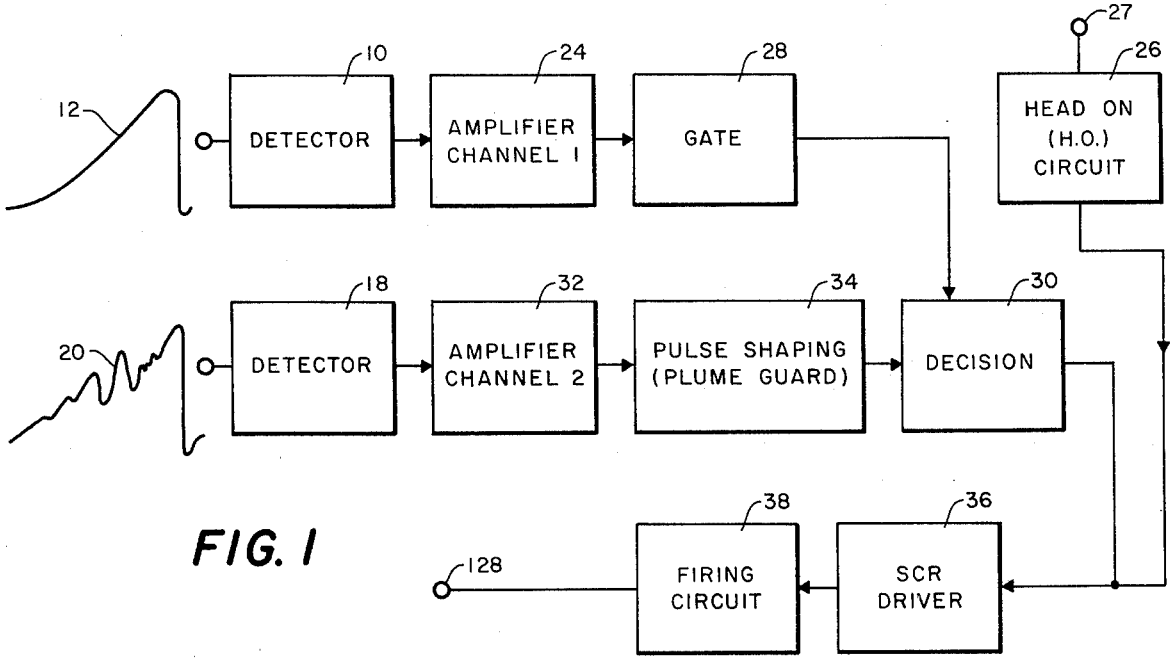
FIG. 1 is a block diagram of the fuzing system embodying the invention.
Figure 2:
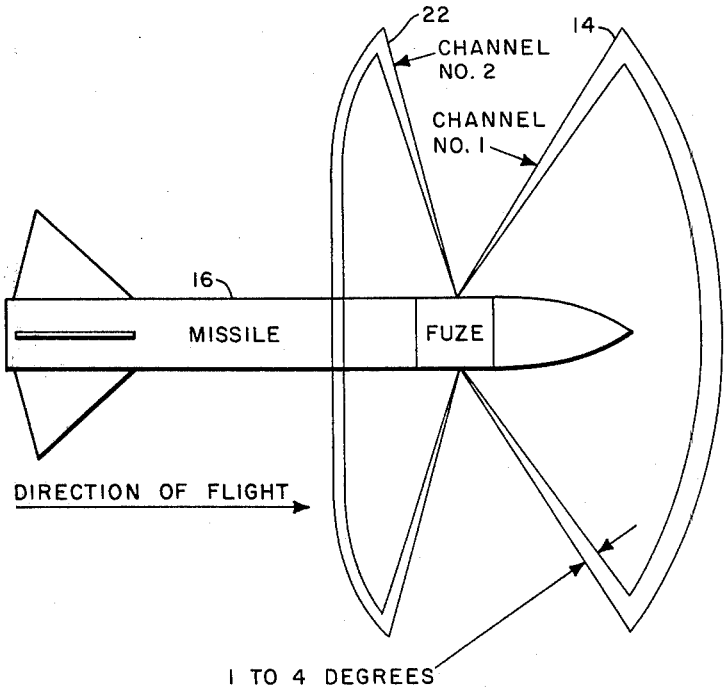
FIG. 2 shows the two optical detection patterns of the fuzing system.

Referring now to the drawings wherein there is shown in FIG. 1 detector 10 of the forward looking channel (channel I) which produces an output signal that is proportional to radiation seen and has an envelope similar to the representative waveform 12. This signal is generated when a target intercepts the forward looking detection pattern 14 which is in the shape of a hollow cone generated about the longitudinal axis of missile 16 (FIG. 2). Detector 18 of the rearward looking channel produces an output signal that is proportional to radiation seen and has an envelope similar to the representative waveform 20. Waveform signal 20 is generated when the target intercepts the rearward looking detection pattern 22 which is also in the shape of a hollow cone generated about the longitudinal axis of missile 16. Detectors 10 and 18 may be of the lead sulfide type or of any other suitable type for detecting infrared energy.

The output of signal of detector 10 is coupled to amplifier 24 where it is amplified and fed to head-on circuit 26 and gate circuit 28. The gate pulse generated by gate circuit 28 is fed to decision circuit 30. The output signal of detector 18 is coupled to amplifier 32 where it is amplified and fed to pulse shaping circuit 34 which integrates out the noise spikes of waveform 20. The output of pulse shaping circuit 34 is fed to decision circuit 30. If a pulse is received from pulse shaping circuit 34 while a gate is present from the output of gate 28, decision circuit 30 will generate an output pulse which is fed to driver circuit 36 which generates an activating pulse which is fed to firing circuit 38. An output pulse from head-on circuit 26 is fed to decision circuit 30 and in effect bypasses gate 28, but only when activated by an activating voltage applied at terminal 27 by the pilot if he determines that the missile will fly a head on intercept path with the target.

Figure 3:
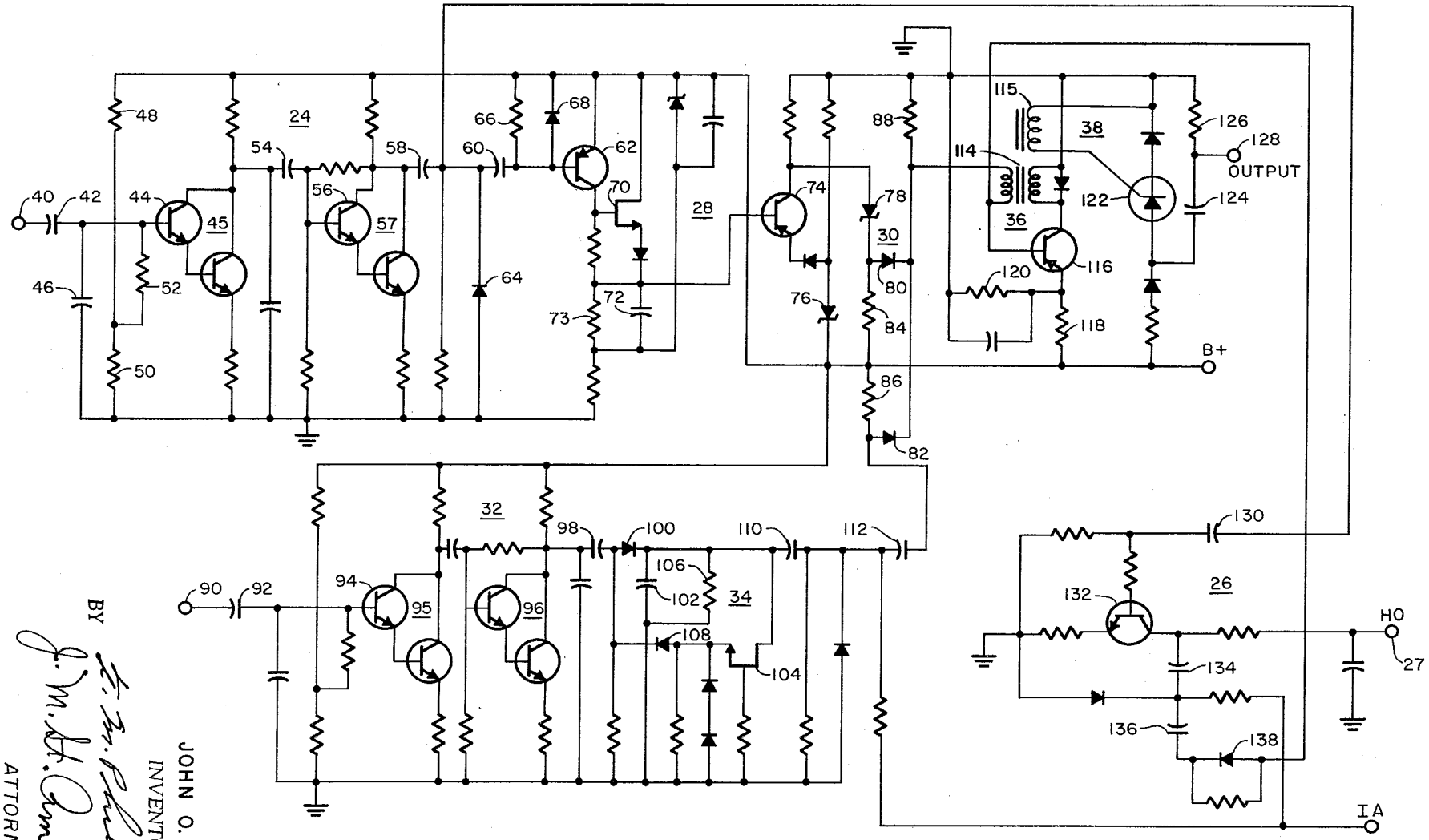
FIG. 3 is a schematic diagram of the embodiment of FIG. 1.

Referring now to FIG. 3, the output signal from detector 10 is applied to terminal 40 where it is coupled through coupling capacitor 42 to the base of transistor 44, the input stage of Darlington amplifier 45 which provides a very high input impedance to match the detector output impedance and provides a reasonable gain as well as low output impedance. Capacitor 46 provides a high frequency bypass to attenuate any high frequency noise signals that may be present. Resistors 48, 50, and 52 form a voltage divider and biasing network for the amplifier. The output signal of Darlington amplifier 45 is coupled through coupling capacitor 54 to the base of transistor 56, Darlington amplifier stage 57. The Darlington configuration is used in the second stage to provide a low output impedance to drive gate circuit 28 and head-on stage 26. The high input impedance of this stage permits capacitor 54 to be smaller by a factor of 10 than if the conventional single transistor amplifier stage had been used. The positive output signal from Darlington amplifier 57 is fed through coupling capacitor 58 to head-on circuit 26 and through capacitor 60 to gate driver transistor 62. Any undesired negative signal overshoot is clipped by diode 64. The trailing edge of the amplified and squared input signal is differentiated by capacitor 60 and resistor 66 before being applied to gate drive transistor 62. The positive portion of this differentiated signal is bypassed to ground through diode 68. The input signal at gate driver transistor 62 is differentiated by capacitor 60 and resistor 66 with the positive portion being bypassed to ground through diode 68. Gate circuit 28 is described in U.S. Patent Application Ser. No. 407,592 filed Oct. 29, 1964, and now U.S. Pat. No. 3,388,272 for Resettable Monostable Multivibrator by John O. Dick and Howard M. Forrester. Gate circuit 28 operates as follows: The negative input to transistor 62 permits it to conduct, thereby turning on silicon-controlled rectifier (SCR) 70, momentarily which charges capacitor 72 to B+ voltage. This positive voltage is coupled to the base of (PNP) transistor 74 (which is normally conducting) thereby cutting it off until capacitor 72 discharges through resistor 73 to its original value. The emitter of transistor 74 is biased at a voltage, E, established by zener diode 76 so that capacitor 72 normally operates at a voltage slightly negative with respect to voltage, E, as its quiescent level. The collector of 74 then operates at a voltage also slightly negative with respect to E, thus transistor 74 is cut off as capacitor 72 charges to B+ and the collector voltage drops to ground for the duration of the gate period. It will be noted that capacitor 72 can be recharged to B+ at any time during its discharge from B+ voltage down to voltage E at which it normally operates. This permits the gate to be accurately reset and the normal gate period generated even though the gate may have been erroneously triggered by a noise pulse just prior to the desired channel I signal. The output of transistor 74 is coupled through zener diode 78 to diode 80 of decision circuit 30. Decision circuit 30 comprises diodes 80 and 82, and resistors 84, 86, and 88.

The output channel II signal from detector 18 is applied to terminal 90 where it is coupled through coupling capacitor 92 to the base of transistor 94, the input stage of Darlington amplifier 95. The operation of amplifier 32 is identical to the operation of amplifier 24. The output of Darlington amplifier 96 is coupled through capacitor 98 to the input of pulse shaping (or plume guard) circuit 34. Pulse shaping circuit 34 is described in U.S. Patent Application Ser. No. 380,957 filed July 7, 1964 for Fuze Signal Processing Circuit by John O. Dick. The purpose of pulse shaping network 34 is to insure that a trigger signal is fed to decision circuit 30 upon the trailing edge of the infrared plume target signature rather than upon any negative spike which may modulate the plume signal. The operation of this circuit is as follows: The peak value of each positive excursion of the plume signal is coupled through positively biased diode 100 and stored upon capacitor 102. The peak value to which capacitor 102 is charged (peak value of the plume signal) is impressed upon the collector of SCR 104. The value of resistor 106 should be chosen to provide a long RC time constant. The normal overshoot of amplifier 32 occurring at the termination of the input signal is coupled through negative conducting diode 108 to the emitter of SCR 104 which serves as a turn on pulse permitting SCR 104 to discharge capacitor 102 very rapidly to ground. This rapid negative discharge pulse is coupled through capacitors 110 and 112 to diode 82 of decision circuit 30.

Decision circuit 30 is a conventional and-gate and operates as follows: Diodes 80 and 82 are biased in the forward direction and will be conducting when there is no gate present at diode 80 and a pulse present at diode 82. When a negative gate from transistor 74 is applied to diode 80, diode 80 will be turned off, but since 82 is still biased in the forward direction and is conducting, the voltage at the common anode junction of diodes 80 and 82 will not change. When the negative pulse is received at diode 82, it too will be cut off. The voltage at the common anode junction of diodes 80 and 82 will drop to a value where either of diodes 80 and 82 will start to conduct again. This change in voltage is coupled through transformer 114 to the base of transistor 116. If an output pulse appears at pulse shaping circuit 34 and there is no gate present at the output of gate circuit 28, there will be no output from decision circuit 30. If a gate is present, then the pulse from pulse shaping circuit will be passed to driver circuit 36. Driver circuit 36 is a blocking oscillator to permit transformer coupling of the trigger pulse to the gate of firing pulse generator SCR 122. The emitter of driver transistor 116 has a hold off bias due to voltage divider resistors 118 and 120. The pulse output from decision circuit 30 is DC coupled through the primary winding of transformer 114 to the base of transistor 116 permitting an approximately three volt bias to provide noise rejection. The use of the blocking oscillator 36 permits regeneration in producing the firing circuit SCR drive pulse and a transformer coupling supplies a very low (approximately three ohms) impedance drive circuit.

The output pulse generated by oscillator 36 is coupled to the base of SCR 122 by means of the pick off winding 115 of the transformer 114. Firing of SCR 122 provides a low impedance path to ground, discharging firing capacitor 124 to ground and generating a low impedance high energy pulse across resistor 126 and squib firing output terminal 128.

Head-on circuit 26 is a squaring amplifier stage using transistor 132 to square or sharpen the leading edge of the output signal from the output of Darlington amplifier 57 of amplifier 24. This permits firing of the warhead upon the leading edge of the channel I or forward looking channel. The leading edge of this squared or sharpened and inverted signal is coupled through capacitors 134 and 136 and negative conducting diode 138 to the base of transistor 116 of driver circuit 36. This permits firing of the blocking oscillator transistor 116 independently of the rearward looking channel II operation. Head-on circuit (head-on mode) 26 is activated when the missile and target aircraft are approaching each other head-on and is provided by an approximately +20 volt bias at input terminal 27 supplied by the guidance unit (not shown) of the missile. This bias is activated in the missile by the pilot prior to missile launch if he has determined that the fuze will intercept a target approaching head on.

Obviously many modifications and variations of the present invention are possible in the light of the above teachings. It is therefore to be understood that within the scope of the appended claims the invention may be practiced otherwise than as specifically described.

What is claimed is:

1. In a two channel optical fuzing system for a guided missile, the combination comprising:

a. a first infrared energy detector for generating an output signal in proportion to infrared energy detected in a predetermined region forward of the missile, b. a gate circuit coupled to said first infrared detector for generating an output of a predetermined time duration when the infrared energy is no longer detected by said first infrared energy detector, c. a second infrared energy detector for generating an output signal in proportion to infrared energy detected in a predetermined region aft of said forward predetermined region, d. decision circuit means coupled to said gate circuit and to said second infrared energy detector for generating an output pulse when the output signal of said second infrared energy detector is received during the presence of an output gate signal from said gate circuit, e. a pulse drive circuit coupled to the output of said decision circuit means to provide a low impedance output, f. circuit means coupled to said pulse drive circuit for initiating an output pulse signal upon the first detection of an infrared source when it is determined that the missile is approaching an infrared source in a head-on direction, g. a firing circuit coupled to the output of a said pulse drive circuit for generating a low impedance high energy pulse in response to an input pulse from said pulse drive circuit.

2. The fuzing system of claim 1 wherein a pulse shaping network is coupled between said second infrared energy detector and said decision circuit means, said pulse shaping circuit comprising:

a. a diode coupled to the output of said second infrared energy detector and being polarized to pass a negative going signal and to block positive going signals, b. a storage capacitor coupled to said diode and being charged to the peak amplitude of said input signal, c. an output terminal, d. a silicon controlled rectifier biased in a nonconducting condition connected across said storage capacitor and coupled to said output terminal, e. a zener diode coupling the output of said amplifier to the control electrode of said controlled rectifier and being in a nonconducting condition while said storage capacitor is being charged and conductive when the magnitude of the charging signal drops to a predetermined value, f. said controlled rectifier being responsive to the current flow through said zener diode to be conductive and thereby discharging said storage capacitor.

* * * * *